US007121834B2

(12) United States Patent
Gerard

(10) Patent No.: US 7,121,834 B2
(45) Date of Patent: Oct. 17, 2006

(54) REORIENTABLE ELECTRICAL RECEPTACLE

(75) Inventor: Kimberly R. Gerard, Concordia, KS (US)

(73) Assignee: IntelliGlobe, Inc.

( * ) Notice: Subject to any disclaimer, the term of this patent is extended or adjusted under 35 U.S.C. 154(b) by 0 days.

(21) Appl. No.: 11/081,282

(22) Filed: Mar. 16, 2005

(65) Prior Publication Data

US 2006/0110947 A1 May 25, 2006

Related U.S. Application Data

(63) Continuation-in-part of application No. 10/996,106, filed on Nov. 23, 2004.

(51) Int. Cl.
*H01R 39/00* (2006.01)

(52) U.S. Cl. ..... 439/21; 439/188; 439/13

(58) Field of Classification Search ..... 439/20–23, 439/188, 1, 11, 13, 914, 501; 361/56; 200/51.1
See application file for complete search history.

(56) References Cited

U.S. PATENT DOCUMENTS

| | | | | |
|---|---|---|---|---|
| 1,098,501 | A | 6/1914 | Haldaway et al. | |
| 2,134,355 | A | 10/1938 | Caldwell | 439/20 |
| 2,288,259 | A | 6/1942 | Gladulich | |
| 2,459,032 | A | 1/1949 | Korth | |
| 2,582,800 | A | 1/1952 | Sorenson | |
| 2,898,572 | A | 8/1959 | Shinn | |
| 3,321,728 | A | 5/1967 | Cocco et al. | |
| 3,437,976 | A | 4/1969 | Nelson | 439/23 |
| 3,771,106 | A | 11/1973 | Matsumoto et al. | 439/23 |
| 3,975,075 | A | 8/1976 | Mason | |
| 4,026,618 | A | 5/1977 | Straka | |
| 4,061,381 | A | 12/1977 | Smal | |
| 4,520,239 | A * | 5/1985 | Schwartz | 191/12.4 |
| 4,583,798 | A | 4/1986 | Blazowich | 439/24 |
| 4,927,376 | A | 5/1990 | Dickie | 439/484 |
| 5,352,122 | A | 10/1994 | Speyer et al. | 439/13 |
| 5,399,093 | A | 3/1995 | Schneider et al. | 439/21 |
| 5,425,645 | A | 6/1995 | Skovdal et al. | 439/23 |
| 5,484,299 | A | 1/1996 | Schlessinger | 439/188 |
| 5,595,503 | A | 1/1997 | Pittman et al. | 439/446 |
| 5,700,150 | A * | 12/1997 | Morin | 439/4 |
| 5,772,447 | A | 6/1998 | Cheung | 439/31 |
| 5,775,921 | A | 7/1998 | Chou | 439/21 |
| 5,967,815 | A * | 10/1999 | Schlessinger et al. | 439/188 |
| 5,997,310 | A | 12/1999 | Chiu et al. | 439/21 |
| 6,068,490 | A * | 5/2000 | Salzberg | 439/25 |
| 6,196,851 | B1 | 3/2001 | Gerard et al. | 439/21 |
| 6,302,743 | B1 * | 10/2001 | Chiu et al. | 439/652 |
| 6,315,617 | B1 * | 11/2001 | Al-Sabah | 439/652 |
| 6,369,999 | B1 * | 4/2002 | Wohlgemuth et al. | 361/111 |
| 6,955,559 | B1 * | 10/2005 | Pyrros | 439/535 |

* cited by examiner

*Primary Examiner*—Michael C. Zarroli
(74) *Attorney, Agent, or Firm*—J. Scott Denko; Fish & Richardson P.C.

(57) ABSTRACT

A reorientable electrical expansion outlet is disclosed having a housing with a housing cavity and rotatable electrical female receptacles seated therein. A plug is provided for connection to another outlet for expanding the other outlet. Preferably, each rotatable female electrical receptacle includes a set of electrical conductors situated in electrical isolation from one another, arranged one above the other. In one embodiment, the housing cavity has a set of annular conductive structures formed one above the other to support provide a set of electrically conductive pathways along which slideable contacts rotateably track. Another embodiment places annular conductive structures on the female receptacle.

19 Claims, 15 Drawing Sheets

REORIENTABLE ELECTRICAL RECEPTACLE

CROSS REFERENCE TO RELATED APPLICATIONS

This application is a continuation-in-part of U.S. patent application Ser. No. 10/996,106, filed Nov. 23, 2004, pending, which is hereby incorporated by reference.

FIELD

The present invention relates to the field of electrical outlets, and in particular, to a reorientable electrical outlet.

BACKGROUND

As the number of electrical appliances in the average household grows, the need for convenient access to numerous electrical outlets grows. Electrical outlets are, of course, well known in the art and typically comprise a face plate, multiple female sockets, and an outlet body.

In a typical residential electrical outlet, the female electrical sockets are fixed in orientation. Such fixed orientation of the socket can reduce the flexibility of the electrical outlet. In some applications, the fixed socket orientation effectively reduces a two-socket outlet to a single-socket outlet.

A variety of techniques have been devised to increase the flexibility of power delivery sockets and plugs. For example, a species of low profile male plugs has been developed that orient the power cord off the axis of the male plug prongs. Rather than extending perpendicularly away from the wall in which the socket is mounted, such power cords extend off to a side or angle and consequently reduce power cord intention into living space or interference with furniture. Such low profile male plugs can, however, reduce the flexibility of the outlet. For example, in polarized socket and plug arrangements, the required directional orientation dictates that the plug be inserted in only one direction. In some cases, particularly in four socket outlets, this can result in power cord interfere with access to other sockets in the same outlet.

There are prior techniques to ensure that the power cord does not overlay other outlet receptacles. Examples of such designs are illustrated in U.S. Pat. No. 4,927,376 to Dickie and U.S. Pat. No. 3,975,075 to Mason. Some of these problems may be resolved by a male plug design in which the cord rotates with respect to the prongs. An example of a rotatable male plug is purportedly shown in U.S. Pat. No. 4,026,618 to Straka. Many of these designs allow free movement between the male plug and power cord around a 360 degree path. The plugs are not, however, designed to be set or held at any particular angular position.

Socket interference can become particularly acute when a transformer for low voltage devices is integrated with a male power socket for direct insertion in a wall outlet. Such box-like transformers may directly block access to other sockets in the outlet face plate.

A conventional electrical outlet ordinarily allows only symmetrical positioning of the multiple female electrical receptacles. Thus, when an integrated male plug-transformer is plugged into one female electrical receptacle of an electrical outlet, an adjacent socket is typically blocked. To mitigate this interference, a multiplug adapter may be inserted into a female electrical receptacle to accommodate multiple male plugs in a given female electrical receptacle of the electrical outlet. Such multiple adapters may present, however, an electrical hazard, in addition to an unsightly mess.

Electrical wiring codes may vary in different parts of a country or from country to country. Some electrical codes require female receptacles in the same electrical outlet box to be positioned horizontally with respect to one another, while other codes require female electrical receptacles in the same electrical outlet box to be positioned vertically with respect to one another. In some instances, electrical appliances can be readily accommodated by an electrical outlet of a certain orientation but may not be suitable for use with electrical outlets oriented at 90 degrees from the given orientation.

Consequently, there is a need for an angularly reorientable electrical socket to accommodate male plugs of a variety of configurations and combinations while remaining substantially fixed at a selected angular orientation.

SUMMARY

A reorientable electrical outlet having a housing cavity in a stationary housing and a rotatable electrical female receptacle seated therein is disclosed. Preferably, the rotatable female electrical receptacle includes a set of electrical conductors situated in electrical isolation from one another, arranged one above the other.

In one embodiment, the housing cavity has a set of annular conductive structures formed one above the other to support provide a set of electrically conductive pathways along which slideable contacts rotateably track. Another embodiment places annular conductive structures on the female receptacle. Such structures slideably track on fixed contacts in the housing cavity. The rotatable female electrical receptacle further includes a set of apertures on a exterior top surface aligned with the electrically conductive sleeves for allowing a set of prongs of a male plug to extend through to acquire electrical contact with the electrically conductive pathways via the electrically conductive sleeves.

DETAILED DESCRIPTION OF PREFERRED EMBODIMENTS

Figure 1:
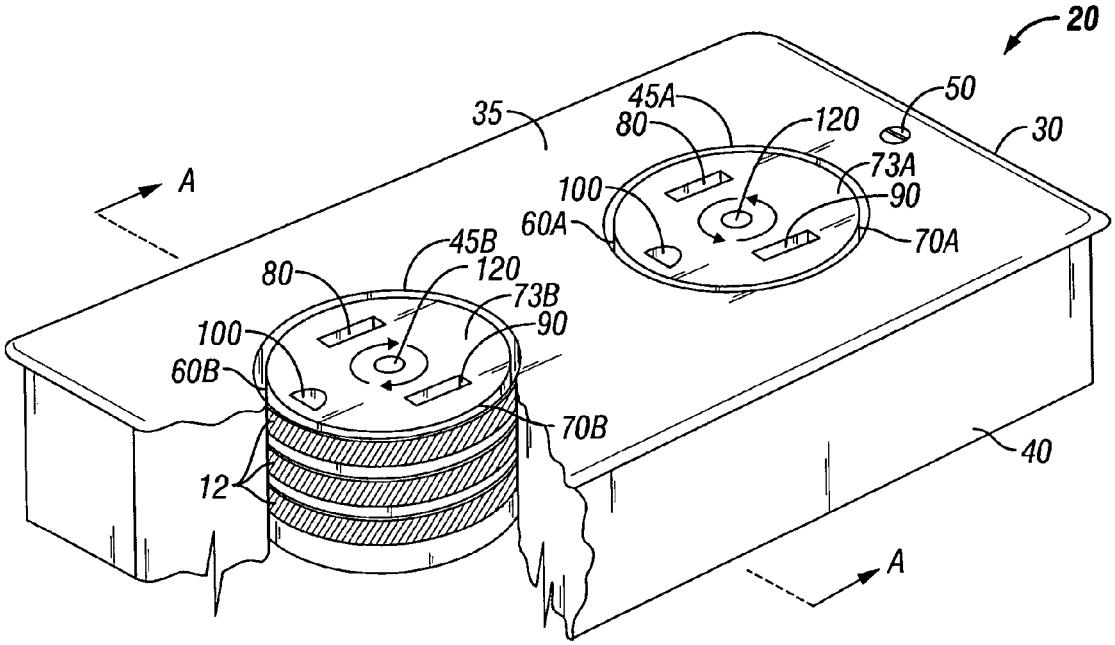
FIG. 1 is a perspective view of a preferred embodiment devised in accordance with the present invention.

FIG. 1 shows a perspective view of a preferred embodiment of the present invention. Reorientable electrical outlet 20 is preferably formed of nonconductive material such as plastic or polyvinyl chloride (PVC). The nonconductive portions may also be formed of nylon or any other suitable supporting material. In some embodiments, outlet 20 may be manufactured using resins containing high impact amorphous polycarbonate (PC) and acrylonitrile-butadiene-styrene (ABS) terpolymer blends, such as Cycoloy® CY6120 from GE Plastics. By varying the ratio of PC to ABS in the resin, outlet 20 may be tailored for residential or industrial use. Further, the overall cost of outlet 20 may be reduced by employing regrind, or powdering, techniques. Preferably, no more than 15% regrind is employed. Outlet 20 is comprised of a plate 30 having a faceplate portion 35 and a receptacle housing 40 having two housing cavities 45A and 45B. Screw holes such as countersunk screw holes 50 receive screws for mounting reorientable electrical outlet 20 in a desired surface, such as an electrical box or wall.

Two female electrical receptacles 60A and 60B (collectively, "60") are accommodated in respective receptacle housing cavities 45A and 45B through circular apertures 70A and 70B. Each of female electrical receptacles 60A and 60B exposed surfaces 73A and 73B, respectively.

Figure 2:
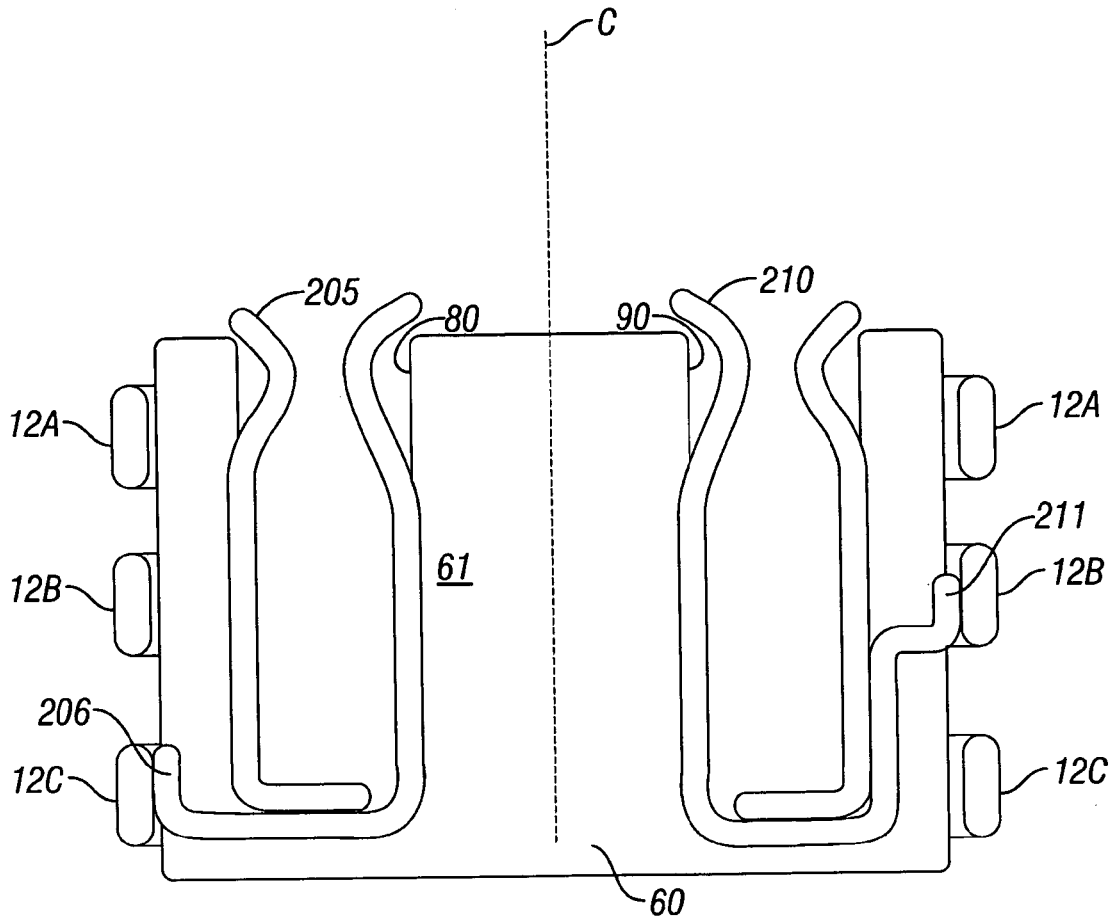
FIG. 2 is a cross-sectional depiction of a female electrical receptacle, the cross section taken along the direction marked "A" in FIG. 1.

Circular apertures 70A and 70B having annular conductive contacts 12 ("contacts 12", "annular contacts 12") shown in the cutaway view of FIG. 1. Annular contacts 12 are preferably made of a metallic conductor such as copper or brass. Preferably, annular contacts 12 disposed about the inner wall of circular apertures 70A and 70B in a manner devised to provide electrical connection to electrical contacts on receptacles 60A and 60B. Such connection will be further described with regard to later-referenced Figures. In such an embodiment, annular contacts 12 may present a fixed inner surface for connection to contacts 205, 210, and 215, respectively, on receptacles 60A and 60B (FIG. 2).

Annular contacts 12 may instead be part of receptacles 60A and 60B. In such an embodiment, annular contacts 12 present a rotating surface to fixed contacts on the inner wall or circular apertures 70A and 70B.

Female electrical receptacles 60A and 60B each further include apertures 80, 90, oriented for insertion of a power plug. The depicted apertures 80 and 90 are generally of different size and shape as may be determined by a specific electrical code and/or standard. Each depicted female electrical receptacle 60A and 60B further includes respective ground apertures 100.

In a preferred embodiment, female electrical receptacle 60A with common aperture 80, power aperture 90, and ground aperture 100 forms a female electrical receptacle subassembly. Female electrical receptacle 60A subassembly fits into circular aperture 70A. The diameter of the aperture 70A is slightly larger than the diameter of the female electrical receptacle 60A subassembly.

The female electrical receptacle 60A and 60B subassemblies are preferably constructed in layers held together by axial screws 120. In a preferred embodiment, axial screws 120 are inserted from the bottom of electrical receptacles 60 and terminate under the surface of an insulative cover plate.

In operation, when male plug 95 is plugged into reorientable electrical outlet 20, it can be easily reoriented to a desired angular position by modifying the angular orientation of rotatable female electrical receptacle 60A, thereby allowing an easy deployment of different orientations of a variety of electrical male plugs having varying sizes and configurations.

Although the depicted preferred embodiments of the invention employ two grounded female electrical receptacles, the invention is usable for a variety of female electrical receptacles including those that employ a single receptacle. It should also be recognized that the apertures 80, 90, and 100 in female electrical receptacles 60 can be replaced by any type of similar female socket that allows proper insertion and contact with a mating male-type conductive prongs of a male plug. Moreover, the invention is not limited to use with 110–220 V AC-type or DC-type appliances.

Figure 3:
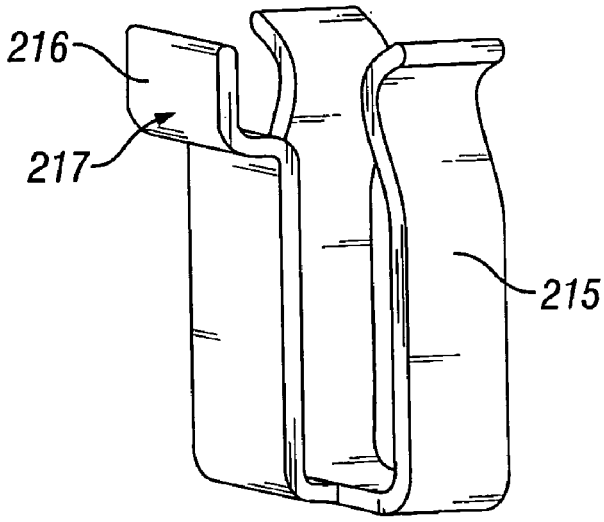
FIG. 3 depicts a conductive sleeve according to a preferred embodiment of the present invention.

FIG. 2 is a cross-sectional depiction of a female electrical receptacle 60, the cross section taken along the direction marked "A" in FIG. 1. In this embodiment, receptacle 60 has conductive sleeves 205 and 210 contained in body 61. Conductive sleeves 205 and 210 are accessible through apertures 80 and 90, respectively (FIG. 1). A third conductive sleeve 215 is depicted in FIG. 3. Conductive sleeves 205, 210, and 215 ("the depicted conductive sleeves") are comprised of a conductive metal such as copper or brass. The depicted conductive sleeves may be made by combining two or more pieces of metal with a fastener. Preferred embodiments of sleeves 205 and 210 are made with two metal pieces.

In this embodiment, sleeves 205 and 210 have conductive contacts paths 206 and 211, respectively. Conductive contacts paths 206 and 211 ("contacts"), which each form a conductive path away from the center C of female receptacle 60. Conductive contact paths 206 preferably traverse or extend across at least a small distance radially, away from the center of receptacle 60 toward the annular contacts 12 which are, in this embodiment, disposed around the outer sides of receptacle 60. Other embodiments may have annular conductive contacts disposed toward the center of receptacle 60, with receptacle 60 rotating about such contacts. The outside is preferred. Contact 206 slideably contacts, or leans on, annular contact 12C. The two portions of the depiction labeled 12C are opposing portions of the same annular contact 12. In this embodiment, contact 206 extends across a distance radially from conductive sleeve 205 to annular contact 12C. Such extension may or may not point in a straight radial direction. Contact 206 is disposed at least partially at the vertical level of annular contact 12C.

Sleeve 210 has conductive contact path 211 traversing, or extending, radially from conductive sleeve 210 to annular contact 12 B. Such a path may or may not point in a direct radial direction. Conductive contact path 211 is disposed at least partially at the vertical level of annular contact 12B in a manner devised to avoid mechanical interference with other conductive contact paths or annular rings when female receptacle 60 is rotated about its center C. Preferably, there is no limit to such rotation and receptacle 60 may be rotated a full 360 degrees. Preferably, sleeves 205 and 210 are formed together with conductive contact paths 206 and 211 by bending their constituent metal pieces.

FIG. 3 depicts a conductive sleeve 215 according to a preferred embodiment of the present invention. In this embodiment, conductive sleeve 215 is accessible through aperture 100 (FIG. 1), which typically corresponds to the ground connection of socket 20. Conductive sleeve 215 has conductive contact path 216 preferably arranged to traverse a radial distance away from center C of receptacle 60. In this embodiment, conductive contact path 216 is at the vertical level of the top annular contact 12A (FIG. 2). Outer contact surface 217 is positioned to slideably contact or lean on annular contact 12A in a manner devised to allow rotation of receptacle 60 inside of annular contacts 12.

Figure 4:
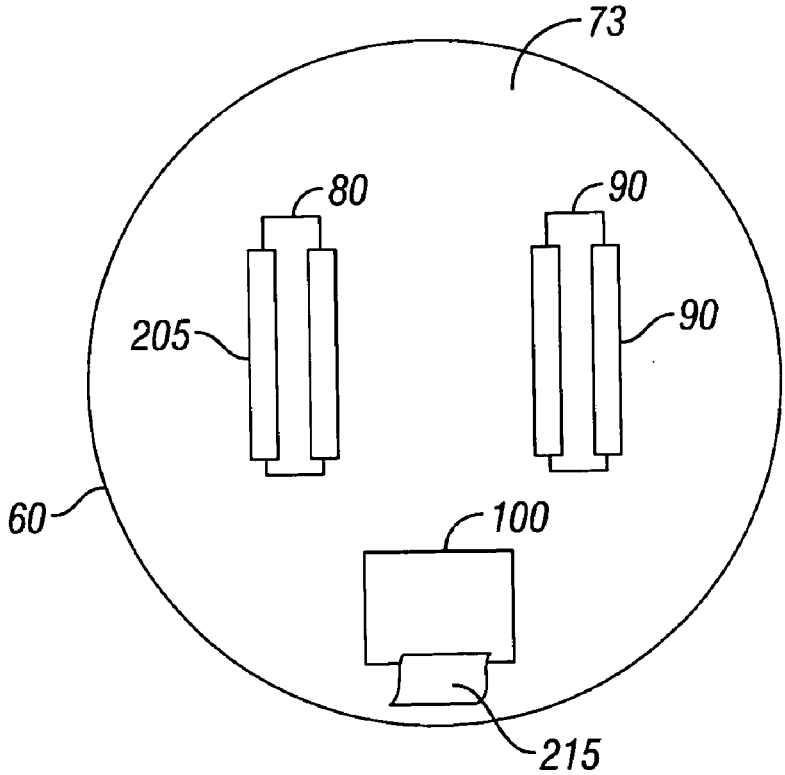
FIG. 4 depicts a top view of a female electrical receptacle according to a preferred embodiment of the present invention.

FIG. 4 depicts a top view of a female electrical receptacle 60 according to a preferred embodiment of the present invention. Apertures 80 and 90 present openings in conductive sleeves 205 and 210 upward for receiving plug prongs. Aperture 100 similarly presents the open top of conductive sleeve 215. In a preferred embodiment, an insulative cover plate is placed over the exposed portions of conductive sleeves 205, 210, and 215 depicted in FIG. 4.

Figure 5:
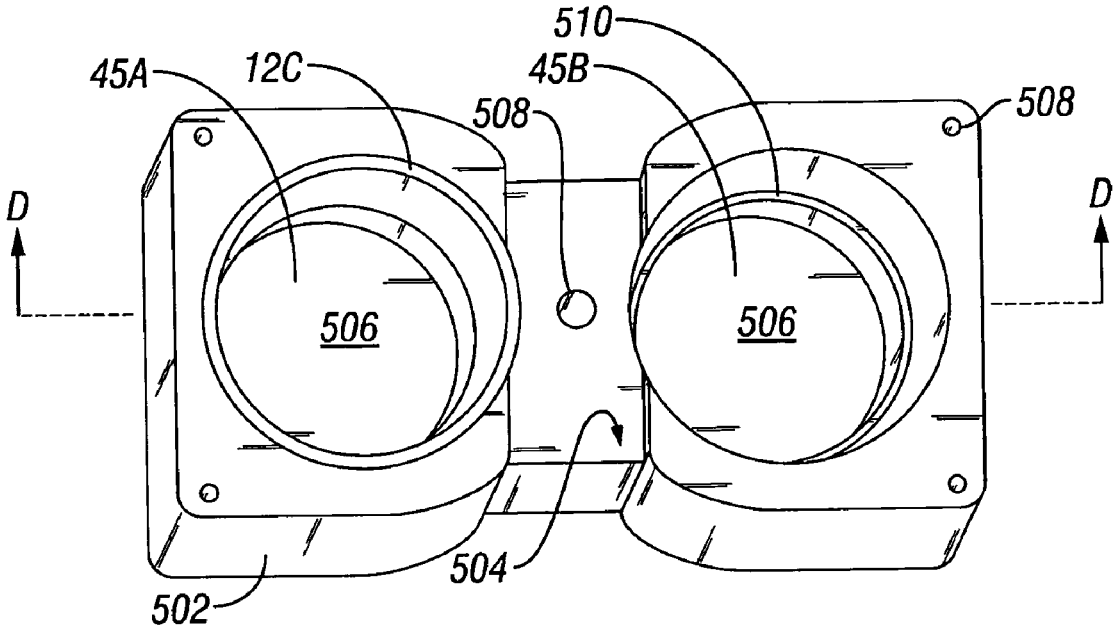
FIG. 5 depicts a bottom portion of a housing of an outlet according to a preferred embodiment of the present invention.

FIG. 5 depicts a bottom portion 502 of housing 40 of outlet 20 according to a preferred embodiment of the present invention.

Figure 6:
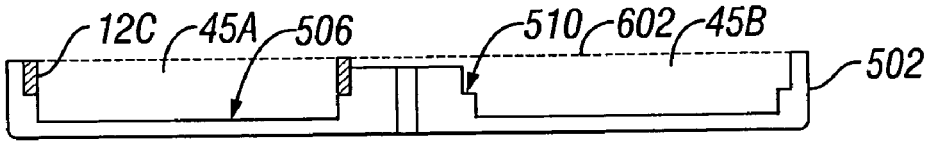
FIG. 6 is a cross sectional depiction of the portion depicted in FIG. 5, the cross section taken along the direction marked "D".

FIG. 6 is a cross sectional depiction of the portion 502 depicted in FIG. 5, the cross section taken along the direction marked "D".

Referring to FIGS. 5 and 6, a housing 40 in this embodiment is constructed in layers with the bottom layer being portion 502. Portion 502 expresses the lower part of housing cavities 45A and 45B, which cavities have floors 506. The depicted portions of cavities 45A and 45B each have a ledge 510 for holding an annular conductive contact 12. Line 602 is shown to indicate the presence, in this embodiment, of slot 504 in the middle of portion 502. Cavity 45A is depicted with annular conductive contact 12C inserted to present a conductive ring portion of the wall of cavity 45A.

One alternative embodiment has no floors 506, and thereby allows connection of a conductive member to a lower portion of annular conductive contact 12.

Figure 9:
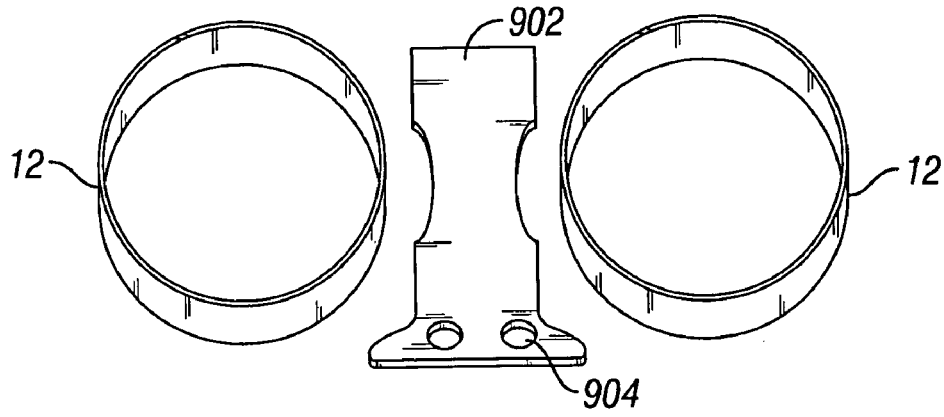
FIG. 9 depicts conductive fittings according to one preferred embodiment of the present invention.

In this embodiment, portion 502 has slot 504 formed in its upper side for insertion of conductive member 902 (FIG. 9). In this embodiment, conductive member 902 forms electrical connection to annular conductive contacts 12, and presents screw holes 904 for attaching electrical wiring. In one preferred sequence of construction, portion 502 is formed and then annular conductive contacts 12 are inserted with an interference fit. Conductive portion 902 is soldered or welded to annular conductive contacts 12. Conductive portion 902 may instead be connected to contacts 12 with only an interference fit, or portion 902 may also be formed with contacts 12 as one piece.

Figure 7:
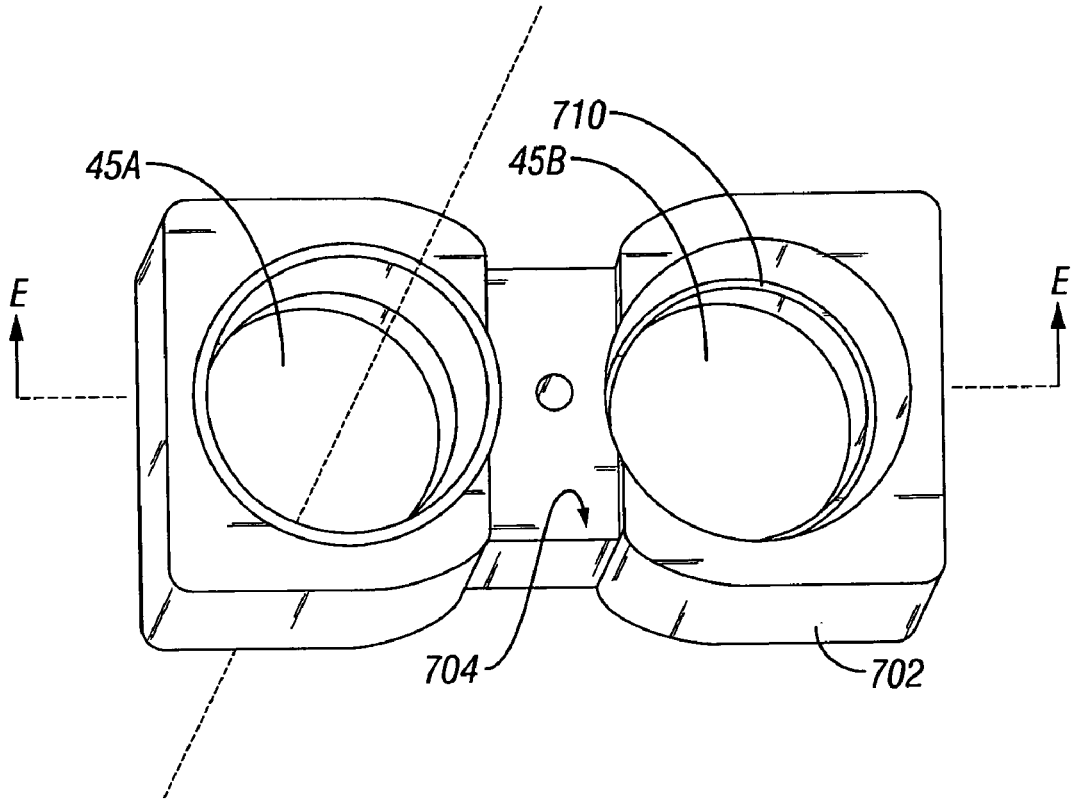
FIG. 7 depicts a portion of a housing according to a preferred embodiment of the present invention.

FIG. 7 depicts a portion 702 of housing 40 of outlet 20 according to a preferred embodiment of the present invention.

Figure 8:
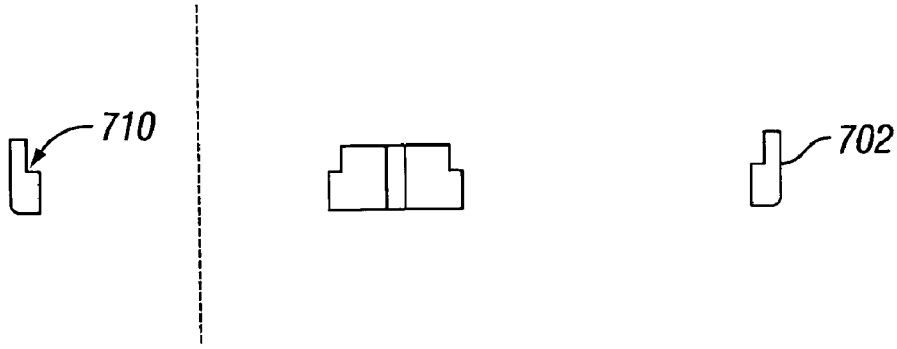
FIG. 8 is a cross sectional depiction of the portion depicted in FIG. 7, the cross section taken along the direction marked "E".

FIG. 8 is a cross sectional depiction of the portion 702 depicted in FIG. 7, the cross section taken along the direction marked "E".

Referring to FIGS. 7 and 8, a housing 40 in this embodiment is constructed in layers with two interior layers being formed each with a portion 702. Portion 702 expresses upper portions of housing cavities 45A and 45B. The depicted portions of cavities 45A and 45B each have a ledge 710 for holding an annular conductive contact 12. Portion 702 has slot 704 formed in its upper side for insertion of conductive member 902 (FIG. 9). In this embodiment, conductive member 902 forms electrical connection to annular conductive contacts 12, and presents screw holes 904 for attaching electrical wiring. In one preferred sequence of construction, portion 702 is formed and then annular conductive contacts 12 are inserted to fit on ledge 710 with an interference fit. Other embodiments may glue or otherwise fasten conductive contacts 12 into place.

FIG. 9 depicts conductive fittings according to a preferred embodiment of the present invention.

Figure 10A:
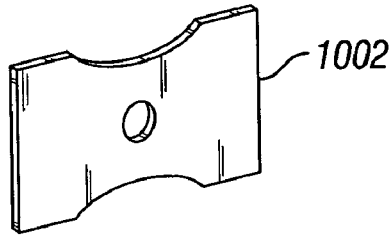
FIG. 10A depicts another conductive fitting according to one preferred embodiment of the present invention.

FIG. 10A depicts another conductive fitting 1002 according to a preferred embodiment of the present invention.

Figure 10B:
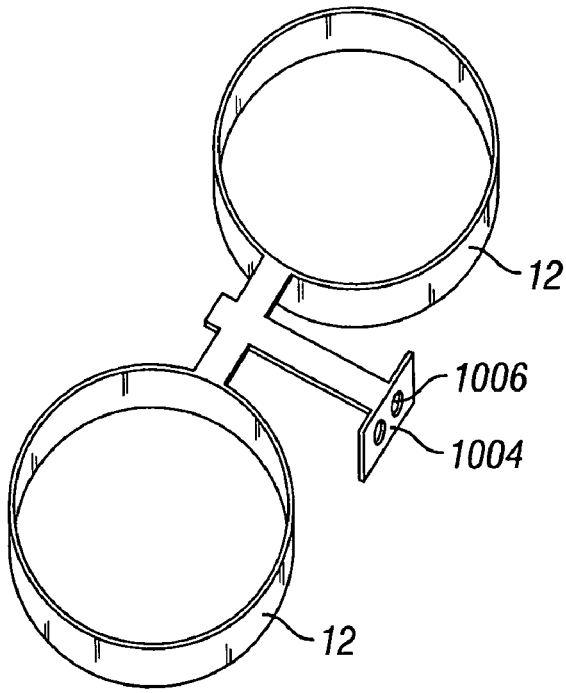
FIG. 10B depicts another conductive fitting according to an alternative embodiment of the present invention.

FIG. 10B depicts another conductive fitting 1004 according to an alternative embodiment of the present invention. In this embodiment, annular conductive contacts 12 are combined with conductive fitting 1004 in a single piece. Conductive fitting 1004 may fit into a slot 504 above lower portion 502. Slot 504 may also be positioned underneath lower portion 502 in a manner devised to allow conductive fitting 1004 to be extend underneath portion 502 to present screw holes 1006 for attachment of electrical wiring.

Figure 11:
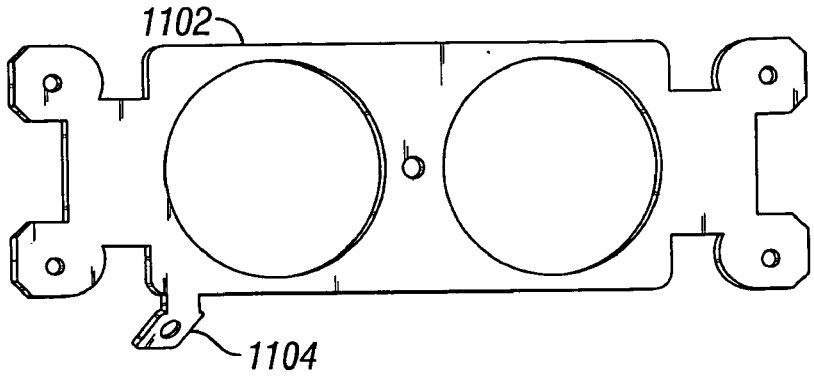
FIG. 11 depicts a top conductive plate according to a preferred embodiment of the present invention.

FIG. 11 depicts a top conductive plate 1102 according to a preferred embodiment of the present invention. Plate 11 has contact 1104 for screw attachment of electrical wiring.

Referring to the preceding Figures, one preferred sequence of assembling a socket 20 according to the present invention is as follows. A bottom portion 502 is provided with annular conductive contacts 12C which are connected to a conductive member 902 placed in slot 504. A first portion 702 is placed atop the bottom portion 502 and provided with annular conductive contacts 12B. A conductive member 902 is placed in the slot 704, in electrical connection with the annular conductive contacts 12B. A second portion 702 is placed atop the first portion 702 and provided with annular conductive contacts 12A. A conductive member 1002 is paced in slot 704 of the second portion 702, and electrically connected to annular conductive contacts 12A. Such connection forms a housing with openings 45A and 45B of each of portions 502 and 702 aligning to form housing cavities.

A first and a second female electrical receptacle assembly 60 are placed in the housing cavities 45A and 45B respectively. Respective electrical connections are made between contacts on assembly 60 and the annular conductive rings as depicted in FIG. 2. Next, a top conductive plate 1102 is placed atop the assembled socket, in electrical connection with the conductive member 1002. A face plate is connected over the top conductive plate.

The various conductive components employed in the depicted embodiment of the present invention are preferably of brass. However, as persons skilled in the art will recognize, any suitable conductive material can be employed for this purpose. For example, use of brass, copper, steel alloys, and other alloys is prevalent. The employed nonconductive components of the depicted embodiment of the present invention can be of any suitable nonconductive or insulating material including plastic and polyvinyl chloride (PAC). Again, those skilled in the art will appreciate that any suitable nonconductive or insulating material may be employed. For clarity of the present exposition, a simple exemplary reorient able electrical outlet 20 is illustrated, although those skilled in the art will appreciate, reorient able electrical outlet 20 described here is adaptable to a variety of models, configurations and may be devised to include many other types of female electrical receptacles and adapters. For example, the present invention may be embodied in an adapter devised to convert a fixed socket to a reorient able facility.

It should also be understood that, the number, form, and structure of female electrical receptacles are merely examples and not to be construed as design limitations required for employment in the present invention. For example, female electrical receptacles 60A and 60B could range from typical residential receptacles, both grounded and non-grounded, all the way up through power strip, 220V receptacles, and up through 480V receptacles including 2, 3, 4, or more prong-receptive designs. These devices can allow for prongs of a variety of male plugs to be inserted into the female electrical receptacles and rotated to any desired positions, so as to allow for non-interfering positioning with regards to other male plugs or other types of restrictions which could preclude the use of any given male plug into an adjacent female electrical receptacle.

In an alternate embodiment of the present invention, female electrical receptacles may be devised to include only oppositely disposed apertures oriented for insertion of conventional power and common prongs of an exemplary non-polarized male plug. Such a two-prong male plug-receptive design of the female electrical receptacles requires no outer concentric annular conductor supporting structure component for the absent ground prong, which is present in the case of the three-prong male plug-receptive preferred embodiment.

Figure 12A:
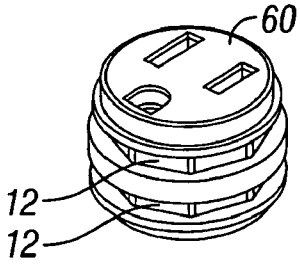
FIG. 12A depicts a female electrical receptacle according to another embodiment of the present invention.

FIG. 12A depicts a female electrical receptacle 60 according to another embodiment of the present invention.

Figure 12B:
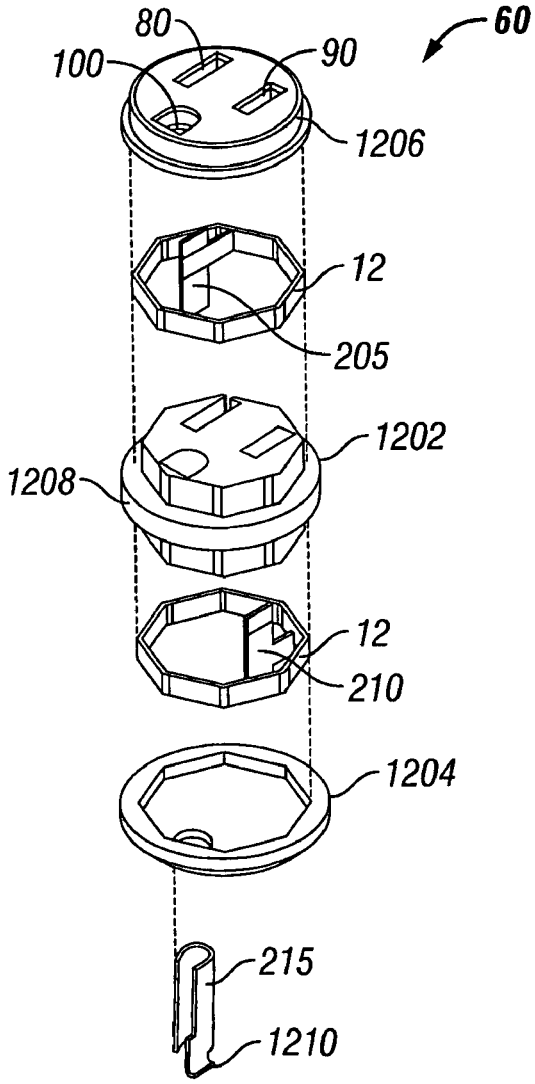
FIG. 12B depicts an exploded view of the female electrical receptacle of FIG. 12A.

FIG. 12B depicts an exploded view of the female electrical receptacle 60 of FIG. 12A. Referring to FIGS. 12A and 12B, in this embodiment female electrical receptacle 60 has annular conductive contacts 12. Contacts 12 are divided are embodied as octagonal brass fittings. In this embodiment, receptacle 60 has only two annular conductive contacts 12. The upper depicted contact 12 is connected to conductive sleeve 205. A portion of conductive sleeve 205 has an inverted-L shape to present a conductive path traversing radially to the respective sleeve 12. The lower depicted contact 12 is connected to conductive sleeve 210. A portion of conductive sleeve 205 has an "L" shape to present a conductive path traversing radially to the lower sleeve 12.

In this embodiment, central support portion 1202 is assembled with conductive sleeves 205, 210, and 215 inserted into the depicted slots, and annular conductive contacts 12 abutting ledge 1208. Lower portion 1204 fits onto central support portion 1202 to lock the lower depicted contact 12 into place. Similarly, slotted cap 1206 fits onto central support portion 1202 to lock the upper depicted contact 12 into place. In this embodiment, sleeve 215 has lower contact portion 1210 for electrically connecting to conductor 1304 (FIG. 13).

Figure 13:
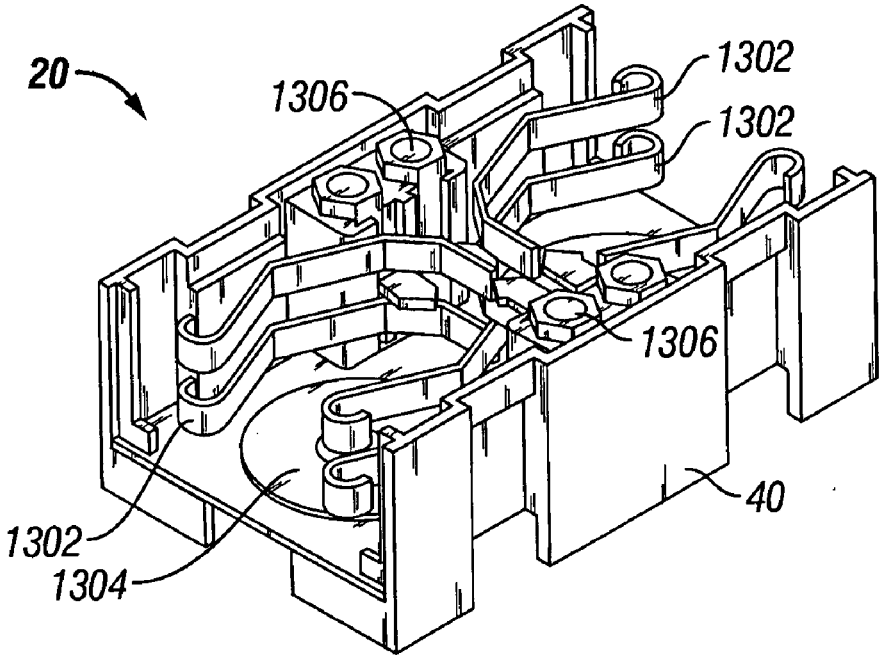
FIG. 13 depicts a housing according to an alternative embodiment of the present invention.

FIG. 13 depicts a housing 40 according to an alternative embodiment of the present invention. Contacts 1302 are devised to receive a rotatable receptacle 60. In this embodiment, contacts 1302 and annular contacts 12 are devised with straightened sections around their circumference. These depicted straight sections may act as stops to provide limit rotational movement of receptacle 60 at certain aligned orientations. Such stops may also be accomplished by, for example, placing indentations or raised bumps or other features Contacts 1302 are electrically connected to selected screws 1306 in a manner devised to support current flow to wires attached to screws 1306. Conductor 1304 preferably receives a ground wire.

Figure 14:
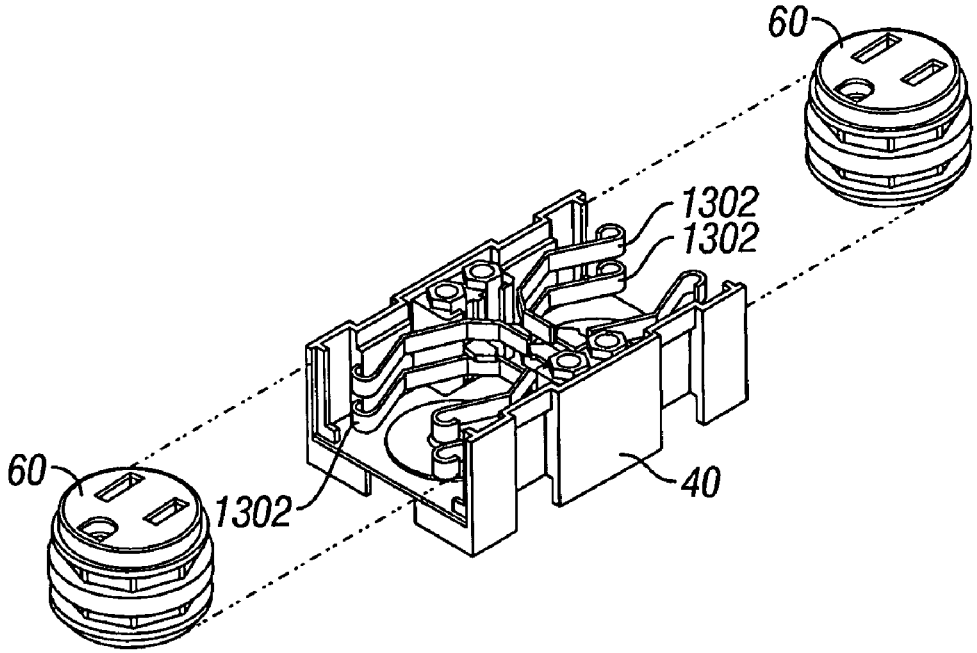
FIG. 14 illustrates an exploded view of outlet depicting how the receptacles fit into the housing according to one embodiment of the present invention.

FIG. 14 depicts an exploded view of outlet 20 of how receptacles 60 fit into the housing 40 according to one embodiment of the present invention. In general, receptacles 60 seat into conductive contacts 1302. For each receptacle 60, conductive contacts 1302 preferably convey the different polarities of electrical power. For example, the upper depicted contact 1302 may convey the hot line voltage for receptacle 60 while the lower depicted contact 1302 may convey the neutral line voltage for receptacle 60.

Figure 15:
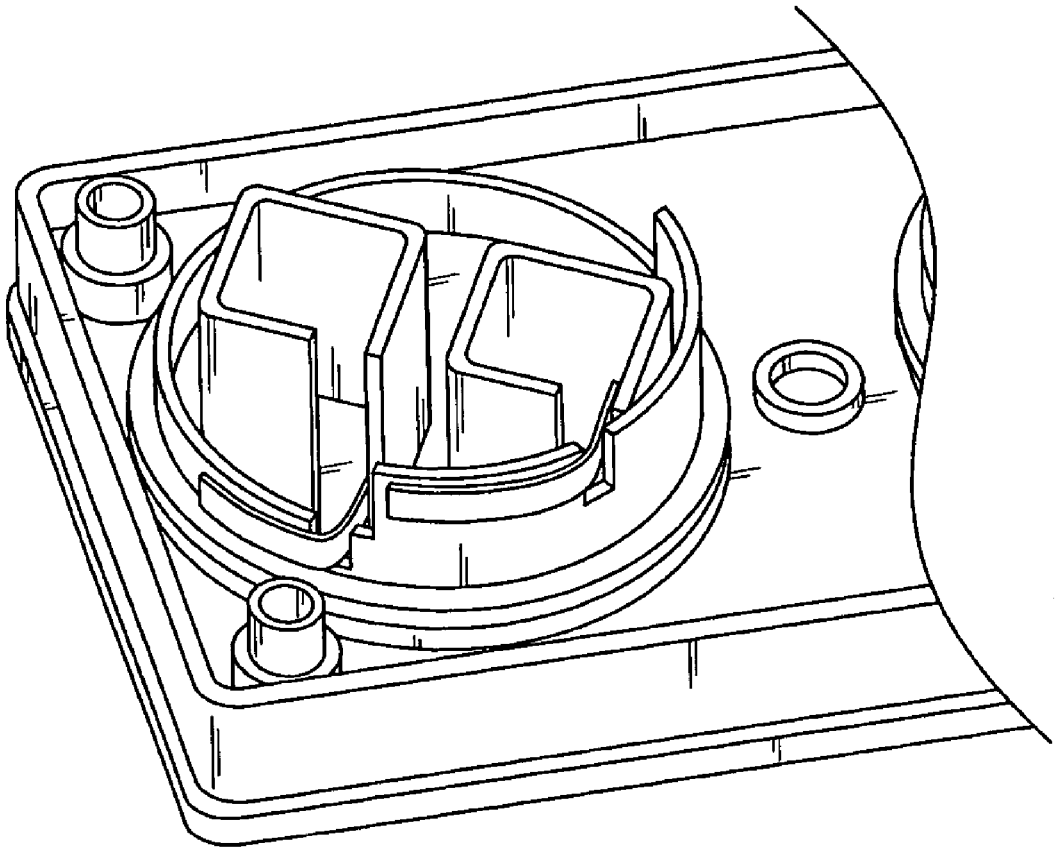
FIG. 15 depicts an portion of a female electrical receptacle according to another alternative embodiment of the present invention.

FIG. 15 depicts another female electrical receptacle 60 according to another alternative embodiment of the present invention. In this embodiment, receptacle 60 has slots 1502 for receiving conductive sleeves 205 and 210. Each of sleeves 205,and 210 preferably has a conductive contact path 1504 shaped to form a spring portion. The spring portions press against or contact annular conductive contacts 12 to create resistance to rotation. Such resistance may be further enhanced by the use of stop features such as, for example, a bump portions on contact path 1502, and/or bump portions on annular conductive contacts 12.

Figure 16A:
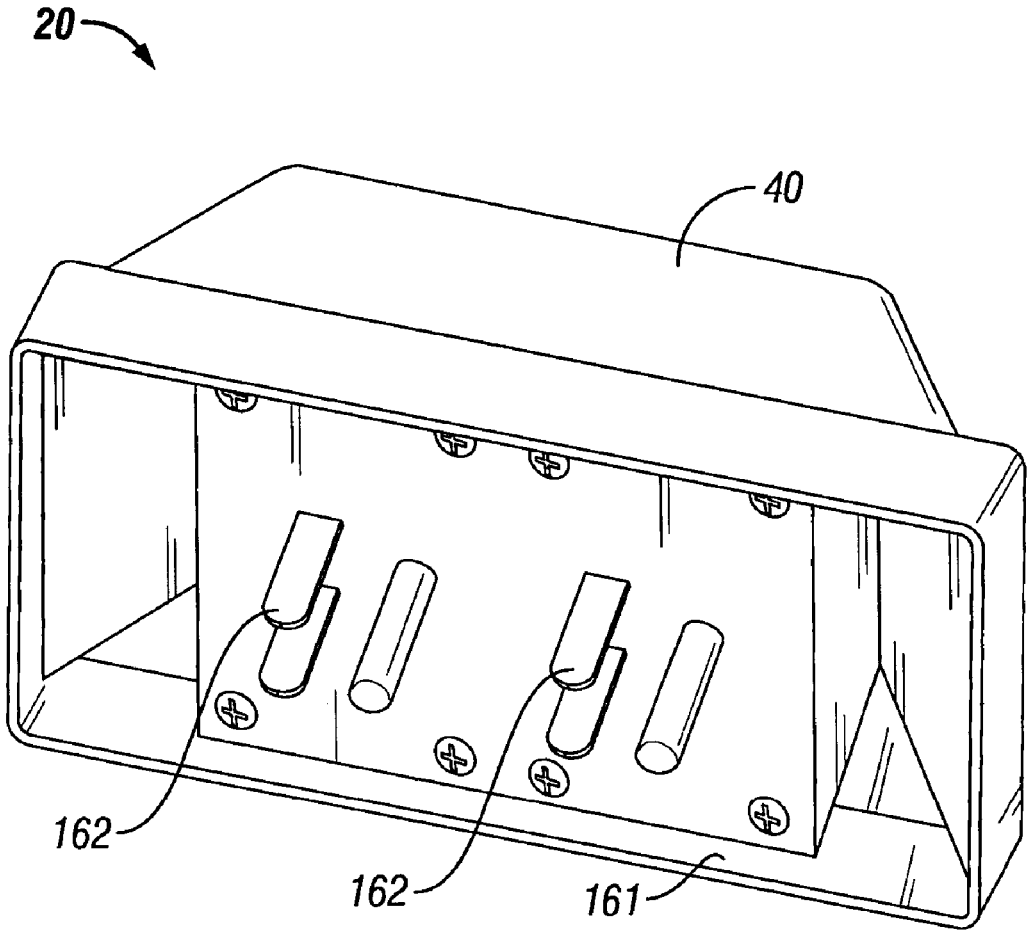
FIGS. 16A and 16B depict an outlet according to another embodiment of the present invention.
Figure 16B:
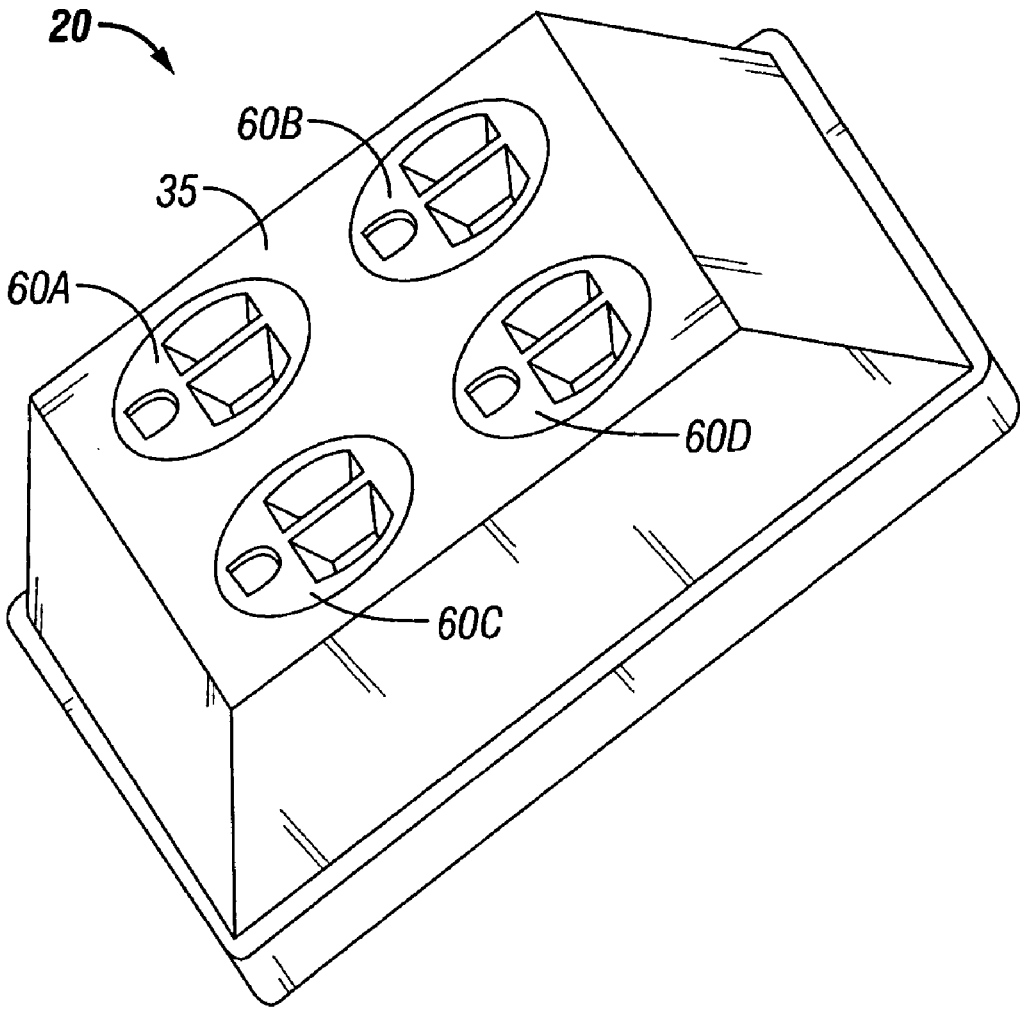

FIGS. 16A and 16B depict an outlet according to another embodiment of the present invention. FIG. 16A is a bottom elevation view. FIG. 16B is a top elevation view. In this embodiment, expansion outlet 20 is provided with plugs 162 for connection to a wall plug or other electrical outlet. While three pronged U.S. standard plugs are shown, other plugs may, of course, be used. The prongs of plugs 162 are preferably connected in parallel to contacts of receptacles 60A–60D in a parallel manner devised to provide four expansion plug receptacles. The depicted outlet has lip 161 devised to fit over a wall outlet faceplate and provide secure mechanical support. Other embodiments may be devised to fit on other types of fixtures. While a two-plug to four-plug expansion outlet is shown, of course other numbers of plugs may be used such as, for example, a one-plug to four-plug outlet.

Figure 17:
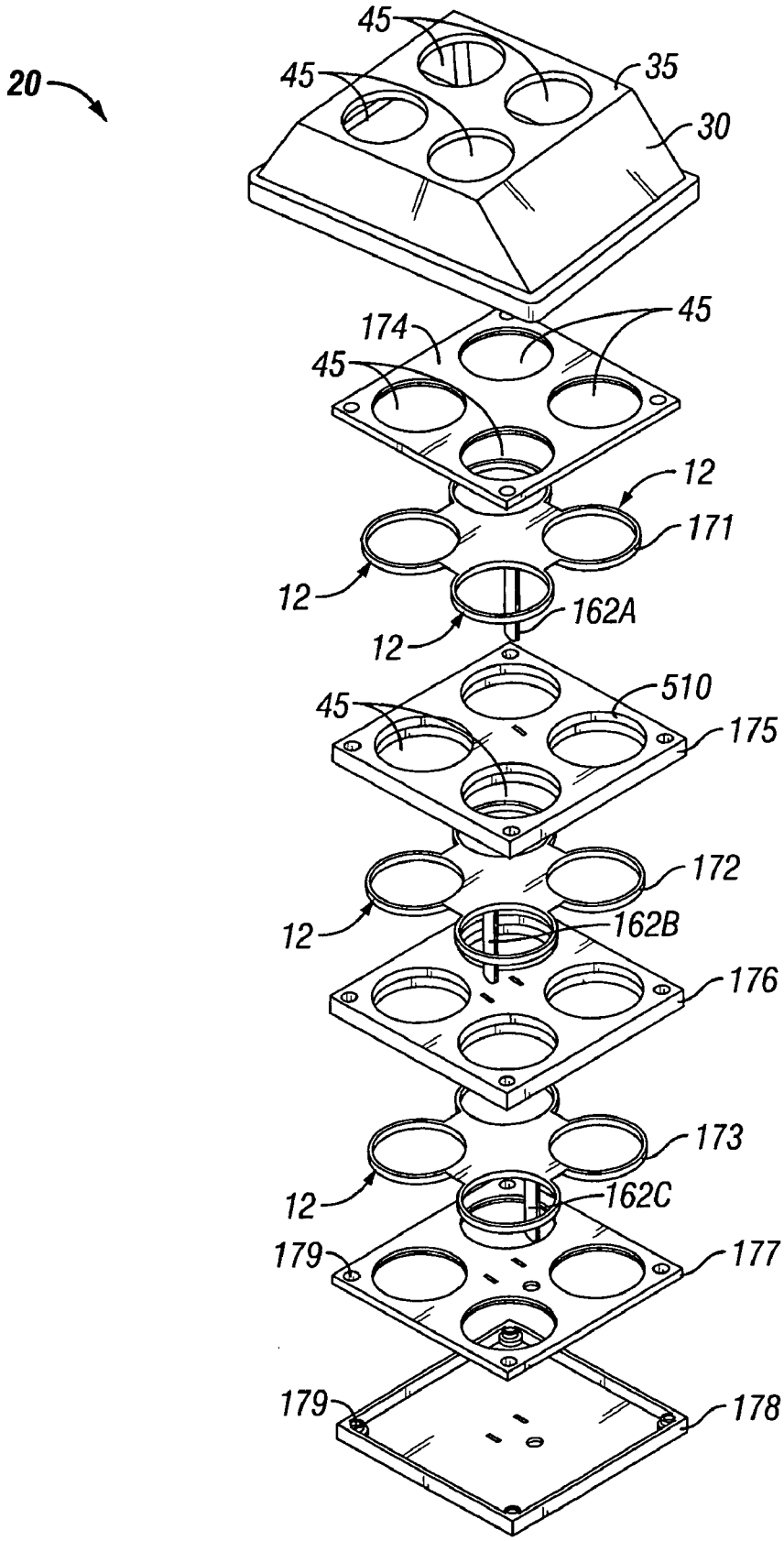
FIG. 17 shows an exploded view of an outlet according to another embodiment of the present invention.
Figure 18A:
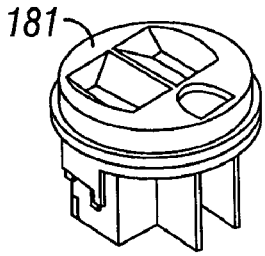
FIGS. 18A–18E depict disassembled parts of a female electrical receptacle according to another embodiment of the present invention.
Figure 18B:
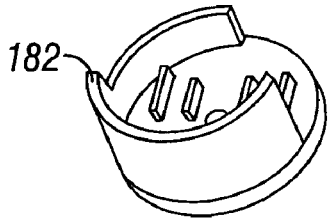
Figure 18C:
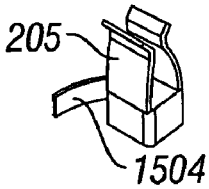
Figure 18D:
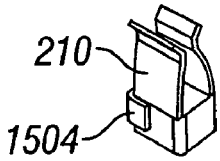
Figure 18E:
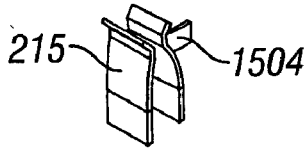

FIG. 17 shows an exploded view of an outlet according to another embodiment of the present invention. Outlet 20 includes a plate 30 having a faceplate portion 35 and several pieces 171–178, which are fitted in a stack and screwed together to make outlet 20. Housing cavities 45 extend through all the depicted pieces except backing piece 178. Female electrical receptacles are fitted into housing cavities 45 in a manner similar to that described with reference to FIG. 1-2.

Depicted below plate 30 is insulating layer piece 174. Below piece 174 is conductive fitting piece 171, designed to fit into piece insulating layer piece 175 in a manner similar to that described with reference to FIGS. 5–6. The depicted piece 175 is fitted with four annular contacts 12 that fit into holes 45 in piece 175. Holes 45 have ledges 510 that support each annular contact and provide insulating separation from annular contacts 12 on conductive fitting piece 172, below piece 175. Conductive fitting piece 172 is similarly disposed in insulating layer piece 176.

In this embodiment, the lowermost depicted conductive fitting piece 173 rests in insulating layer piece 177. Piece 177, in this embodiment, has no ledge 512, but instead annular contacts 12 of piece 173 rest on backing piece 178. While in this embodiment conductive fitting pieces have annular contacts 12 with their tops connected by a flat piece, other embodiments may have other structures for connecting the four annular contacts 12 together such as, for example, a plate connected to the bottom of annular contacts 12.

Still referring to FIG. 17, conductive fitting pieces 171–173 each have a prong, 162A–C, for forming plug 162A–C. Prongs 162A–C project through the depicted holes in the various insulating layer pieces and backing piece 178. Preferably, prongs 162 have a staggered length such that they make a plug with uniform or desired prong length at the exterior side of backing 178 when the depicted parts are assembled.

FIGS. 18A–18E depict disassembled parts of a female electrical receptacle according to another embodiment. The depicted parts are similar to those shown in FIG. 15. Conductive contact sleeves 205, 210, and 215 are devised to fit on bottom piece 182. Next, top piece 181 fits over the contact sleeves. Spring portions 1504 then disposed at three distinct levels along the exterior of the assembled receptacle such that they contact conductive sleeves 12 when the receptacle is inserted into housing cavities 45.

Figure 19A:
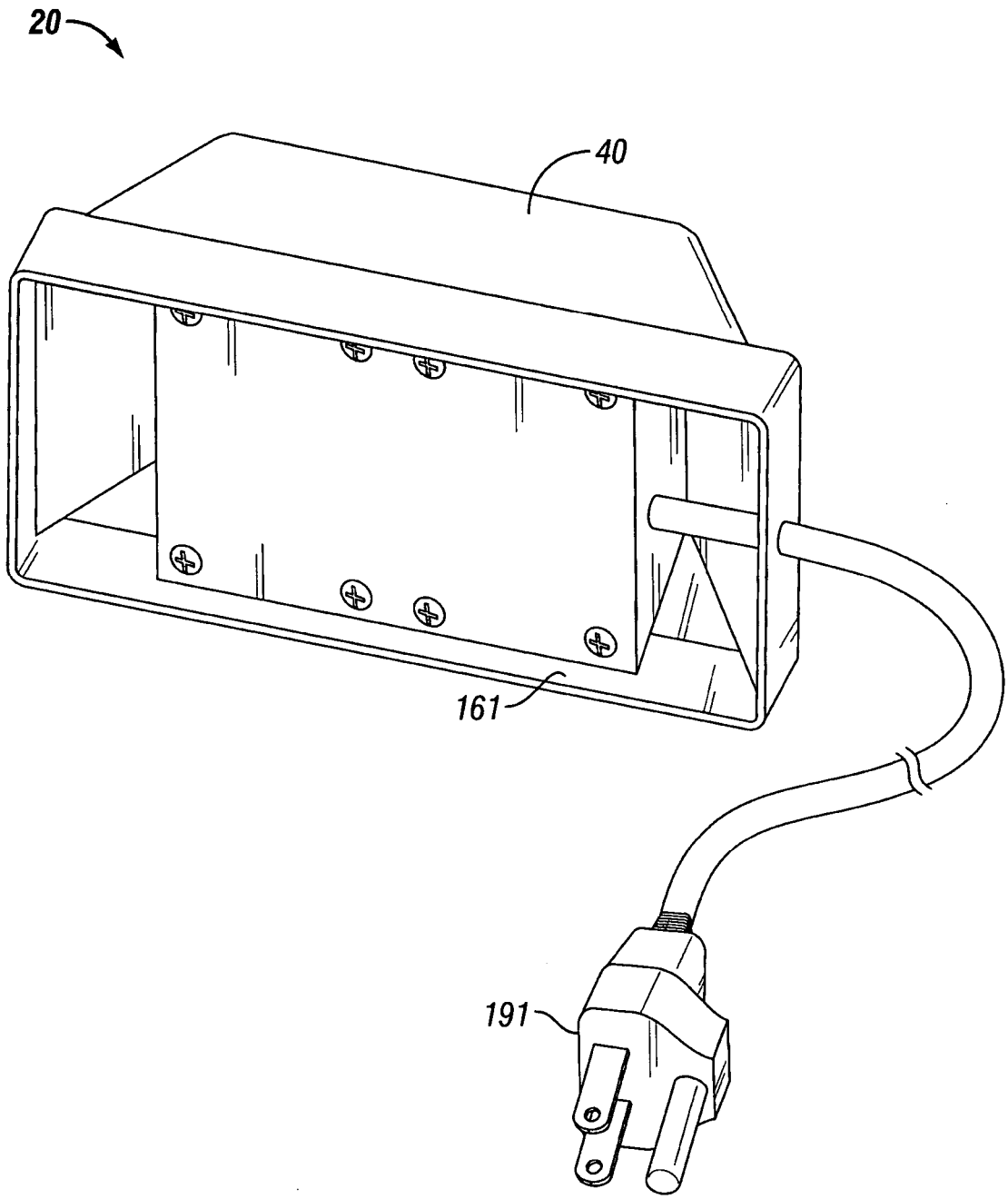
FIG. 19A and 19B depict an outlet according to another embodiment of the present invention.
Figure 19B:
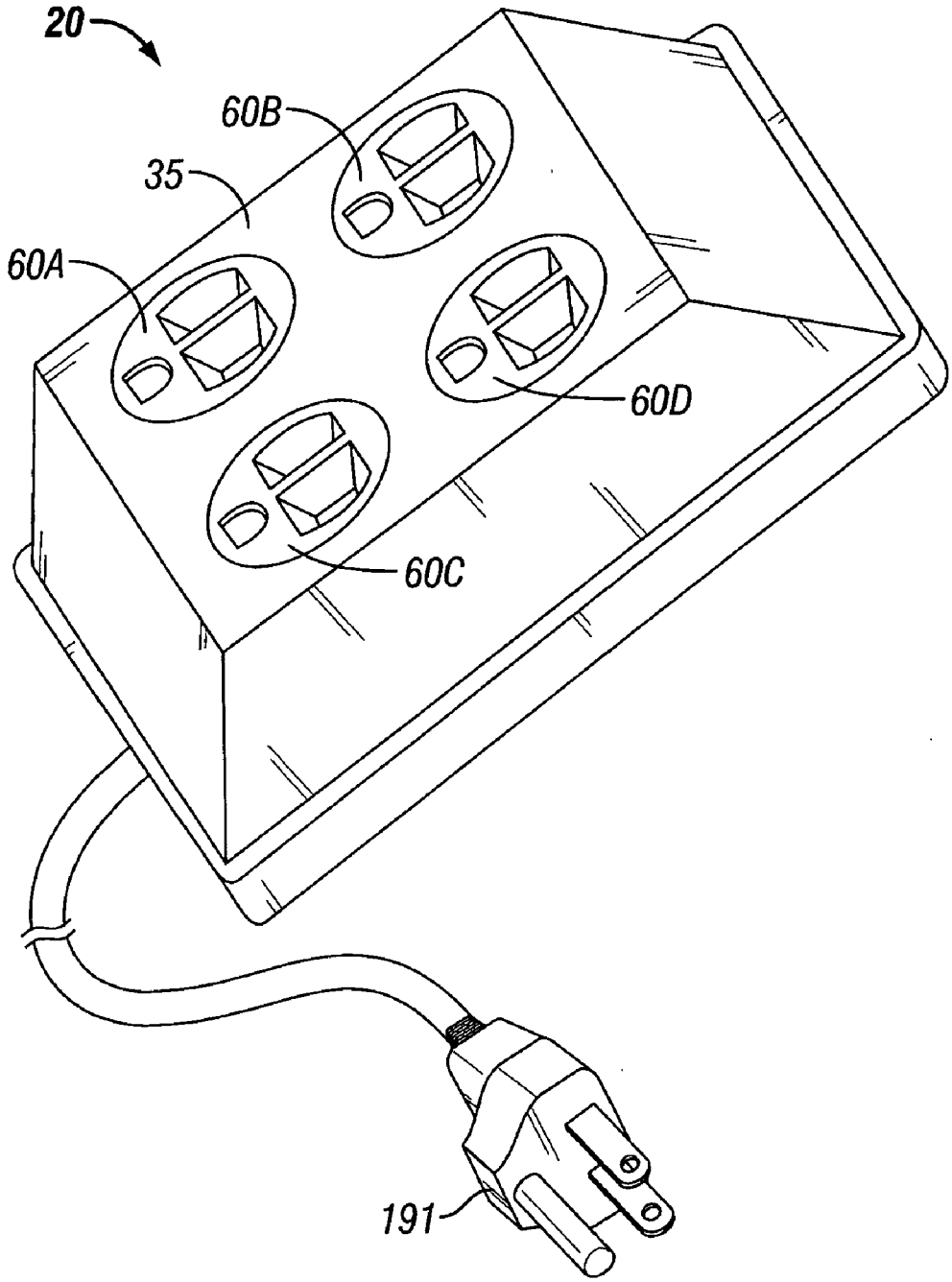

FIG. 19A and 19B depict an outlet according to another embodiment of the present invention. FIG. 19A is a bottom elevation view. FIG. 19B is a top elevation view. In this embodiment, outlet 20 is provided with four rotate-able plug receptacles similar to those shown in FIG. 16B. This embodiment has an extension cord plug 191, rather than a fixed plug, attached to housing 40.

As those of skill in the art will understand after appreciating this specification, the inventive concepts herein may be used in a variety of applications. For example, the rotatable outlets and expansion outlets described herein may be build for use with any voltage standard and plug design. Further, a ground fault interrupt (GFI) outlet having a ground fault circuit interrupter (GFCI) having, for example, reset or test buttons, may be used in combination with the concepts described herein, and various power strip designs with various numbers of receptacles may be used.

Although the embodiments herein have been described in detail, it will be apparent to those skilled in the art that many embodiments taking a variety of specific forms and reflecting changes, substitutions and alterations can be made without departing from the spirit and scope of the invention. The described embodiments illustrate the scope of the claims but do not restrict the scope of the claims.

The invention claimed is:

1. A reorient able electrical expansion outlet comprising:

a stationary housing;

two or more female electrical receptacles, each having first and second electrically conductive sleeves electrically isolated from each other;

two or more housing cavities disposed in the stationary housing to receive the female electrical receptacles, respectively, the housing cavities each having a substantially circular wall along which are disposed first and second annular conductive paths, one above the other, the first and second annular conductive paths at least partially encircling one of the electrical receptacles;

at least one electrical contact having an integral spring portion formed in an arcuate contact surface, the arcuate contact surface disposed in contact with a respective one of the first and second annular conductive paths; and an electrical plug having first and second electrical prongs adapted for connection to a wall outlet, the first and second electrical prongs electrically connected in parallel to the first and second annular conductive paths, respectively, of each housing cavity.

2. The reorient able electrical outlet of claim 1 further comprising:

in each female electrical receptacle, a third electrically conductive sleeve electrically isolated from the first and second electrically conductive sleeves and a third conductive path in electrical communication with the third electrically conductive sleeve.

3. The reorient able electrical outlet of claim 1 in which the first and second annular conductive paths are fixedly disposed along the wall of the housing cavities.

4. The reorient able electrical outlet of claim 1 in which the first and second annular conductive paths are rotatably disposed along the wall of the housing cavities.

5. The reorient able electrical outlet of claim 4 in which the first conductive sleeve has an L-shaped portion and the second conductive sleeve has an inverted-L-shaped portion.

6. The reorient able electrical outlet of claim 1 in which the electrical contact is stationary and its arcuate contact surface is slideably disposed against a respective one of the first and second annular conductive paths, which is rotatably disposed relative to the electrical contact.

7. The reorient able electrical outlet of claim 1 in which the electrical plug is fixed to the housing.

8. The reorient able electrical outlet of claim 1 in which the electrical plug is disposed on an extension cord, the extension cord protruding from the housing.

9. A reorient able electrical expansion outlet comprising:

a housing;

first and second housing cavities disposed in the housing, the first and second housing cavities each having first and second annular conductive paths disposed therein;

first and second female electrical receptacle assemblies adapted to be inserted at least partially in the first and second housing cavities, respectively, with the respective first and second annular conductive paths disposed at least partially around the first and second female electrical receptacle assemblies, respectively;

each female receptacle assembly having first and second electrically conductive sleeves electrically isolated from each other and having first and second conductive contacts the first and second conductive contacts having first and second spring members partially disposed against the first and second annular conductive paths, respectively, the first and second female electrical receptacle assemblies being rotatable in the first and second housing cavities, respectively, while slideably maintaining the first and second spring members in contact with the first and second annular conductive paths; and an electrical plug having first and second electrical prongs adapted for connection to a wall outlet, the first and second electrical prongs electrically connected in parallel to the first and second annular conductive paths, respectively, of each housing cavity.

10. The reorient able electrical expansion outlet of claim 9, wherein the first and second annular conductive paths are disposed one above the other.

11. The reorient able electrical outlet of claim 9 in which the electrical plug is fixed to the housing.

12. The reorient able electrical outlet of claim 9 in which the electrical plug is disposed on an extension cord, the extension cord protruding from the housing.

13. The reorient able electrical outlet of claim 9, wherein the housing is made of one or more layer portions having ridges for inserting the first and second annular conductive paths.

14. The reorient able electrical outlet of claim 9 in which each female electrical assembly further comprises:

a third electrically conductive sleeve electrically isolated from the first and second electrically conductive sleeves; and a third conductive contact in electrical communication with the third electrically conductive sleeve.

15. The reorient able electrical outlet of claim 14 wherein the first and second female electrical receptacles further comprise:

an exposed surface;

first, second and third apertures through the exposed surface aligned with the first, second and third electrically conductive sleeves to allow first, second, and third prongs of a male plug to extend through the first, second, and third apertures respectively, to acquire electrical contact with the first, second, and third electrically conductive sleeves.

16. The reorient able electrical outlet of claim 15, wherein the male plug can be rotated 360 degrees.

17. The reorient able electrical, outlet of claim 9 in which the stationary housing is at least partially made of resins containing high impact amorphous polycarbonate and acrylonitrile-butadiene-styrene.

18. An electrical expansion outlet comprising:

a housing comprising two or more annular conductive paths disposed one above the other around an electrical receptacle;

the electrical receptacle comprising two or more arcuate spring like contacts each slideably disposed against a respective annular conductive path, the electrical receptacle being at least partially rotatable with respect to the housing; and an electrical plug electrically connected to the annular conductive paths, the electrical plug adapted for connecting the expansion outlet to another electrical outlet.

19. The electrical expansion outlet of claim 18 in which the two or more annular conductive paths are formed of conductive fitting pieces separated by one or more insulating layer pieces.

* * * * *